US009962739B2

(12) United States Patent
Malmberg et al.

(10) Patent No.: US 9,962,739 B2
(45) Date of Patent: May 8, 2018

(54) SUPPORT FOR TENSIONED SCREENING MEDIA

(71) Applicant: SANDVIK INTELLECTUAL PROPERTY AB, Sandviken (SE)

(72) Inventors: Mats Malmberg, Rydsgard (SE); Thomas Fransson, Trelleborg (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days. days.

(21) Appl. No.: 15/543,520

(22) PCT Filed: Jan. 16, 2015

(86) PCT No.: PCT/EP2015/050777
§ 371 (c)(1),
(2) Date: Jul. 13, 2017

(87) PCT Pub. No.: WO2016/112994
PCT Pub. Date: Jul. 21, 2016

(65) Prior Publication Data
US 2017/0368577 A1 Dec. 28, 2017

(51) Int. Cl.
*B07B 1/49* (2006.01)
*B07B 1/46* (2006.01)
*B07B 1/36* (2006.01)

(52) U.S. Cl.
CPC ..... *B07B 1/4609* (2013.01); *B07B 1/36* (2013.01)

(58) Field of Classification Search
CPC ..... B07B 1/36; B07B 1/4609
USPC ..... 209/399, 405, 412
See application file for complete search history.

(56) References Cited

U.S. PATENT DOCUMENTS

| | | | | | |
|---|---|---|---|---|---|
| 2,255,939 | A * | 9/1941 | Overstrom | B07B 1/48 | 209/403 |
| 2,790,552 | A * | 4/1957 | Symons | B07B 1/46 | 209/395 |
| 4,219,412 | A | 8/1980 | Hassall | | |
| 5,248,043 | A * | 9/1993 | Dorn | B07B 1/4645 | 209/399 |
| 2008/0257719 | A1 | 10/2008 | Suratt | | |
| 2016/0356108 | A1 * | 12/2016 | Kutryk | E21B 21/065 | |

FOREIGN PATENT DOCUMENTS

| | | | | |
|---|---|---|---|---|
| FR | 1089947 | A | 3/1955 | |
| JP | 2012076054 | A * | 4/2012 | |
| JP | 2012076054 | A | 4/2012 | |
| WO | 02/074454 | A1 | 9/2002 | |
| WO | WO-02074454 | A1 * | 9/2002 | B07B 1/4645 |
| WO | 2005092523 | A1 | 10/2005 | |

* cited by examiner

*Primary Examiner* — Terrell H Matthews
(74) *Attorney, Agent, or Firm* — Corinne R. Gorski

(57) ABSTRACT

An elongate capping is arranged to support cross-tensioned or pre-tensioned screening media at a screen deck. The capping includes a pair of arms to grip a carrier beam of the screen deck and a head attached to the arms via a neck. The head includes flexible widthwise extending flanges that are configured to bend and compress towards the arms to support the screening media when mounted on the head under tension.

15 Claims, 5 Drawing Sheets

SUPPORT FOR TENSIONED SCREENING MEDIA

RELATED APPLICATION DATA

This application is a § 371 National Stage Application of PCT International Application No. PCT/EP2015/050777 filed Jan. 16, 2015.

FIELD OF INVENTION

The present invention relates to a capping to support tensioned screening media at a screen deck.

BACKGROUND ART

Screening apparatus such as vibrating screen decks are used for a variety of applications and may comprise interchangeable square or rectangular screen elements that provide a screen surface upon which bulk material may be deposited and graded by size. Alternatively, the screen (commonly referred to as the screening media) may be of a cross-tensioned, length-tensioned or pre-tensioned media type having a sheet-like structure that extends between lengthwise extending sides of the screen deck. In particular, the tensioned screening media may be formed from wire mesh, metal sheet or reinforced polyurethane/rubber.

Wire mesh media is advantageous as it is easy to mount, relatively low cost and includes a large open structure to facilitate screening a greater range of stone or gravel fractions.

Cross-tensioned and length-tensioned screening media is mounted in the vibrating screen using hooks or fastenings attached to the side or end walls of the screen deck whilst pre-tensioned media is typically pressed downwardly onto the lower support frame by abutment brackets also mounted at the side or end walls. The screen media is supported from below by support beams spaced apart and arranged parallel to the sidewalls. The support beams are typically arranged at different heights in order to support media between the sidewalls in a crowned profile (or upwardly raised or hump-shaped) when secured in position.

Vibrating screen decks may also comprise modular screen elements in which the screening media comprises interchangeable panels that are tessellated together between the deck walls. An example modular screening deck is described in U.S. Pat. No. 4,219,412. Hybrid screen decks are also known comprising both the tensioned and modular media as described in US 2008/0257719. Modular screen decks are disadvantageous as the modular panels are manufacturer specific and are therefore higher cost and not as accessible as tensioned screening media.

Example tensioned screening media decks are described in JP 2012/076054 and WO 2005/092523. JP 2012/076054 discloses 'cappings' that are mounted on top of the parallel support beams to provide a cushioned support for the media and avoid accelerated wear due to friction. However, where the media comprises a continuously open structure along its length, it is common for stones or gravel to become lodged between the media and the cappings which both affects how the media sits upon the deck frame (by changing its orientation angle) and significantly increases the abrasion contact between the capping and the media to accelerate wear. It is therefore known to provide screening media with 'blinds' (elongate strip regions of the media that are devoid of screening apertures) spaced apart along the length of the media with these blinds configured to be supported directly from below by the cappings in an attempt to address the problem of stone entrapment. However, alignment of the 'blinds' with the cappings is not always optimised and also such non-standardised media tends to be higher cost and not as accessible. Accordingly, what is required is screening apparatus that addresses the above problems.

SUMMARY OF THE INVENTION

It is an objective of the present invention to provide screening apparatus and in particular a capping for a screening media support beam that is configured to support tensioned screening media having an open structure or apertures that extend continuously along the length of the screening media between its lengthwise ends (positioned at the sidewalls of the screen deck). It is a further specific objective to provide a support capping that does not facilitate entrapment of stones or gravel between the capping and the screening media during use. It is a yet further objective to provide a capping that facilitates mounting of cross-tensioned, length-tensioned or pre-tensioned screening mediate to create a crowned or humped-shaped screen deck that is effective to 'blind' the media from below so as to effectively close the open structure or apertures at the region of each capping.

The objectives are achieved by providing a capping having arms configured to clamp onto the media support beam and a head configured to support an underside surface of the screening media where the head is flexible so as to provide and maintain close-touching contact with the underside surface of the media to effectively 'close' the open mesh or apertures of the media at its underside surface. In particular, the head of the capping is separated from the arms by a neck such that the head comprises laterally outward extending flanges that are configured to flex and compress downwardly towards the arms when positioned to support the media from below. When in the supporting configuration, in contact with the underside surface of the media, a media contact surface of the head is arranged to be substantially co-planar with the media underside surface and in particular not to curve or be declined downwardly away from the media underside surface that would otherwise create pockets between the media surface and the head for entrapment of stones and gravel.

According to a first aspect of the present invention there is provided an elongate capping to support tensioned screening media at a screen deck, the capping comprising: a pair of opposed spaced apart arms between which is defined a channel to receive and mount the capping on a longitudinal carrier beam of the screen deck; characterised by: a neck provided at one end of and forming a bridge between the arms; and a head provided at the neck and having flexible flanges that extend laterally outward from the neck, the flanges configured to flex and resiliently compress towards the arms to support the screen media when mounted under tension on the head.

Preferably, the head comprises a media contact surface that extends over the flanges, the contact surface being generally concave in a lateral widthwise direction of the head between respective endmost edges of the flanges. Optionally, the contact surface may be considered to be inclined over each flange in a lateral widthwise direction of the head relative to a central region positioned over the neck. Such an arrangement is advantageous to provide complete contact between the surface of the capping head and the underside surface of the media to completely close or blind the media open structure or apertures at a region directly above the capping. Stones and gravel are accordingly prevented from being entrapped at the region of each capping.

Preferably, a distance by which each flange extends laterally outward from the neck is in a range 40 to 80%, 50 to 70% or more preferably 55 to 65% of a thickness of the neck in a lateral widthwise direction of the capping. This relative 'overhang' of the flanges beyond the neck ensures the flanges are provided with sufficient flex to bend downwardly towards the arms to support the media in the crowned or upwardly curved orientation.

Preferably, the flanges are separated from the arms in a height direction of the capping by a length of the neck in the height direction and a shoulder region of each arm at a junction with the neck is declined to slope downwardly away from each respective flange. The downwardly sloping shoulders of the upper ends of arm increase the range of available flex of each flange to provide appropriate cushioning of the media during use. Preferably, a thickness of each flange in a height direction of the capping increases in a lateral widthwise direction of the head such that widthwise outer regions of the flanges are thicker than corresponding widthwise inner regions of the flanges that form a junction with the neck. Such an arrangement is convenient for manufacture and provides the concave or laterally raised shaped profile of the media contact surface of the head without compromising the integrity of the capping.

Preferably, the capping further comprises a plurality of fingers extending from each of the arms into the channel. Preferably, the fingers are inclined to extend in a direction within the channel towards the neck. Optionally, each capping comprises two arms and three fingers on each of the respective arms, the fingers spaced apart in a height direction of the capping between a first end of each arm furthest from the neck and a second end of each arm connected to the neck. Optionally, the fingers comprise a uniform thickness between their innermost ends positioned at the inner region of the channel and a base region of each finger provided at the junction with each arm. However, according to further implementations, the thicknesses of the fingers may taper. Optionally, the fingers may comprise barbed, profiled, ribbed or dimpled surface profiles to increase the frictional contact with the carrier beam to provide a secure mounting of the capping.

Preferably, the capping comprises a flexible material such that the flanges are resiliently compressible towards the arms. Preferably, the fingers are resiliently compressible towards each respective arm. Accordingly, the fingers and flanges are configured to bend when positioned in contact with the carrier beam and media, respectively and to return to their non-flexed configuration when the capping is either detached from the carrier beam or the media. Preferably, the arms are resiliently expandable to open the channel to receive and mount the capping. The flexible fingers and/or arms are advantageous to provide a universal capping suitable for mounting upon support beams of different dimensions and geometries. Optionally, the capping is formed as a moulded single unitary body and comprises a rubber or a polyurethane material.

According to a second aspect of the present invention there is provided a screen deck comprising: a frame having a plurality of carrier beams; a tensioned screening media supported upon the carrier beams; and a plurality of cappings as claimed herein mounting upon the carrier beams to support in touching contact the screening media.

Preferably, the screening media comprises an open structure or a plurality of apertures to allow the downward passage of media, the open structure or apertures extending continuously along a length of the media in a direction perpendicular to the carrier beams such that the cappings are positioned directly below the open structure or apertures and are configured to blind the open structure or apertures at a region of the media immediately above each respective capping. Optionally, the screening media comprises a mesh, a steel mesh, a sheet material, a metal sheet, a rubber or polyurethane layer or sheet all comprising gaps or apertures to allow the downward passage of material to be screened such as gravel, stones and the like.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
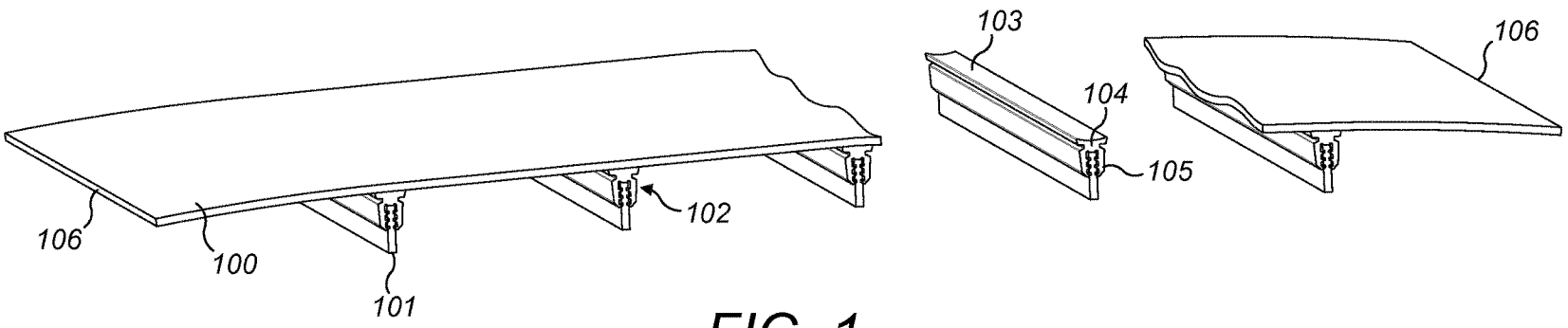
FIG. 1 is a perspective view of a part of a vibrating screen deck comprising cross-tensioned screening media supported upon a plurality of support beams and cappings according to a specific implementation of the present invention.
Figure 2:
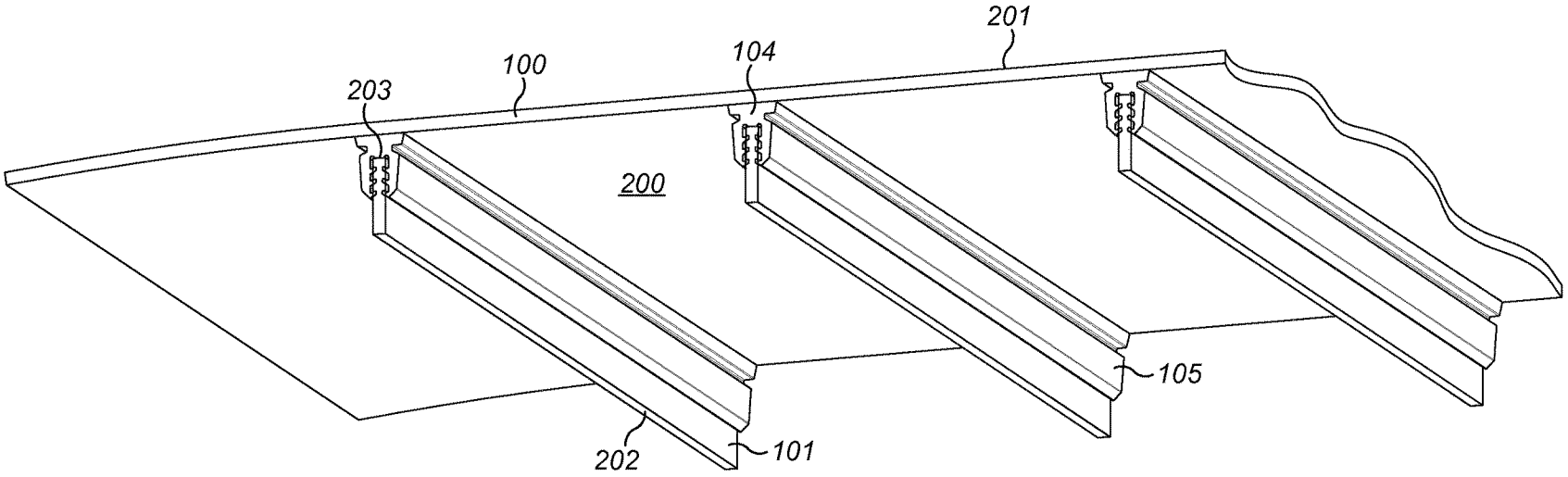
FIG. 2 is an underside perspective view of the screening media and cappings of FIG. 1.

Referring to FIGS. 1 and 2, a vibrating screen deck comprises sheet-like cross-tensioned screening media 100 onto which may be deposited bulk material to be screened such as stones, gravel and the like. Media 100 typically comprises rubber or polyurethane and comprises an open structure (aperture) through which the bulk material may fall when deposited on an uppermost surface 201. Media 100 at its endmost edges 106 comprises hooks (not shown) for attachment to a fastening (not shown) provided on the sidewalls (not shown) of the screen deck so as to mount the media 100 under tension. A plurality of support beams 101 extend parallel to one another and to the sidewalls of the screen deck so as to be aligned generally perpendicular to the length of media 100 between end edges 106. Beams 101 typically comprise steel and have a generally rectangular cross-sectional profile having a lower elongate end surface 202 and an upper elongate end surface 203 positioned closest to and directly below an underside surface 200 of media 100.

Media 100 is supported indirectly from below by the support beams 101. Direct support is provided by a plurality of cappings 102 mounted on the upper ends of the beams 101 such that the cappings 102 are positioned intermediate media 100 and each of the beams 101. In particular, each capping 102 is mounted on the end surface 203 so as to shroud the upper half of each support beam 101 and provide a cushioned mounting and support of the media 100 at the screen deck. Such an arrangement is advantageous to avoid accelerated wear of the media 100 and beams 101 due to the frictional contact during use. To provide the cushion support, each capping 102 is formed from a resiliently deformable material such as a rubber or a polyurethane.

According to the specific implementation, the open structure or apertures within the media 100 extend continuously between the endmost edges 106 such that the cappings 102 are positioned directly below the open structure or apertures so as to 'blind' them from the underside surface 200. That is, media 100 is devoid of any generally solid or non-aperture regions (as is known in the art) positioned conventionally immediately above the cappings 102.

Each capping 102 comprises a first lower region 105 configured for mounting and gripping onto the generally upper half of a respective support beam 101, and a second upper region 104 for positioning in contact with the lower planar surface 200 of media 100. Second region 104 comprises a media contact surface 103 positioned in direct contact with media underside surface 200. As will be appreciated, the lowermost end surface 202 of beams 101 is attached or mounted to further frame parts (not shown) of the screen deck.

Figure 3:
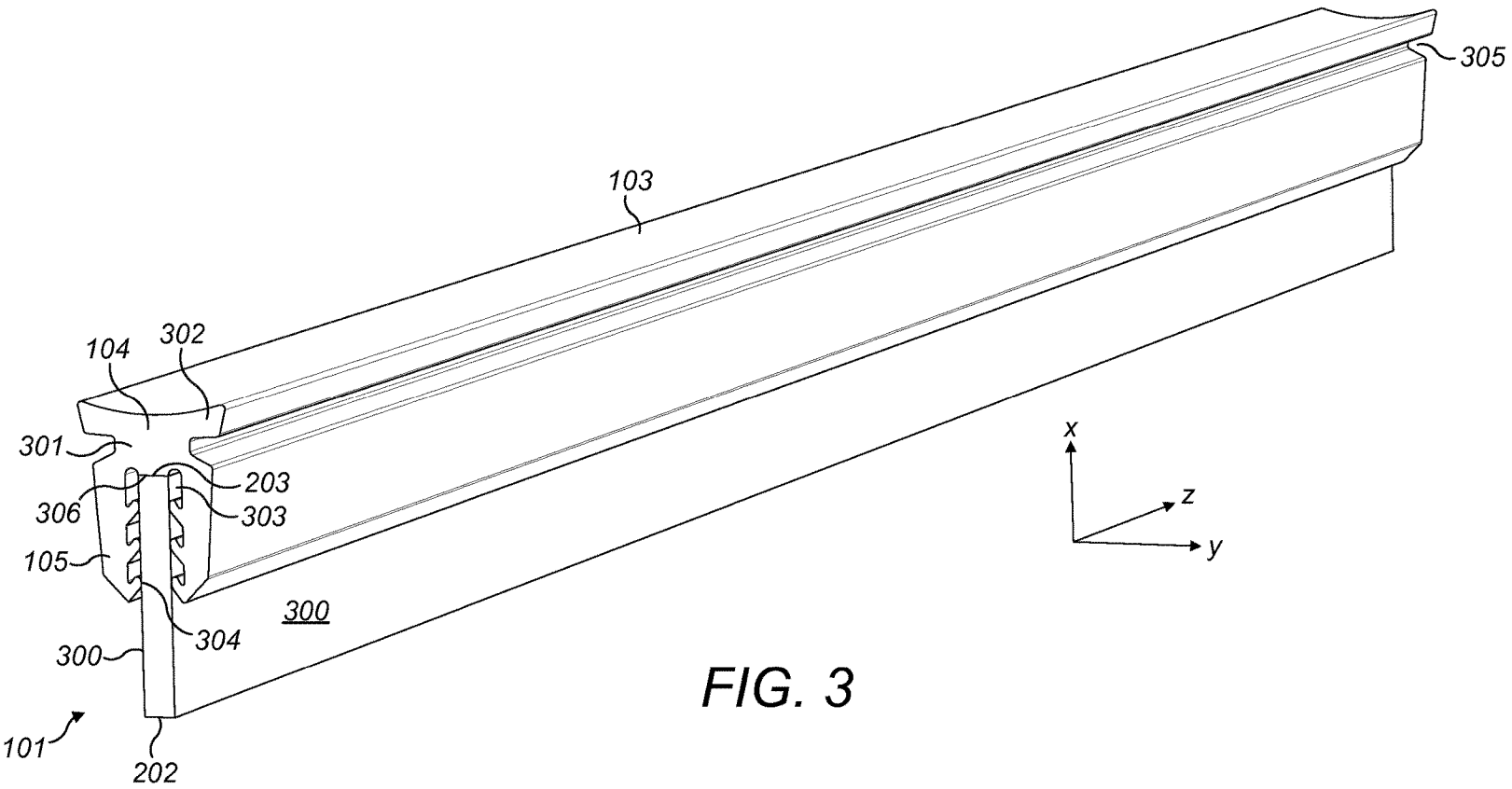
FIG. 3 is a perspective view of a support beam and capping of FIG. 2.
Figure 4:
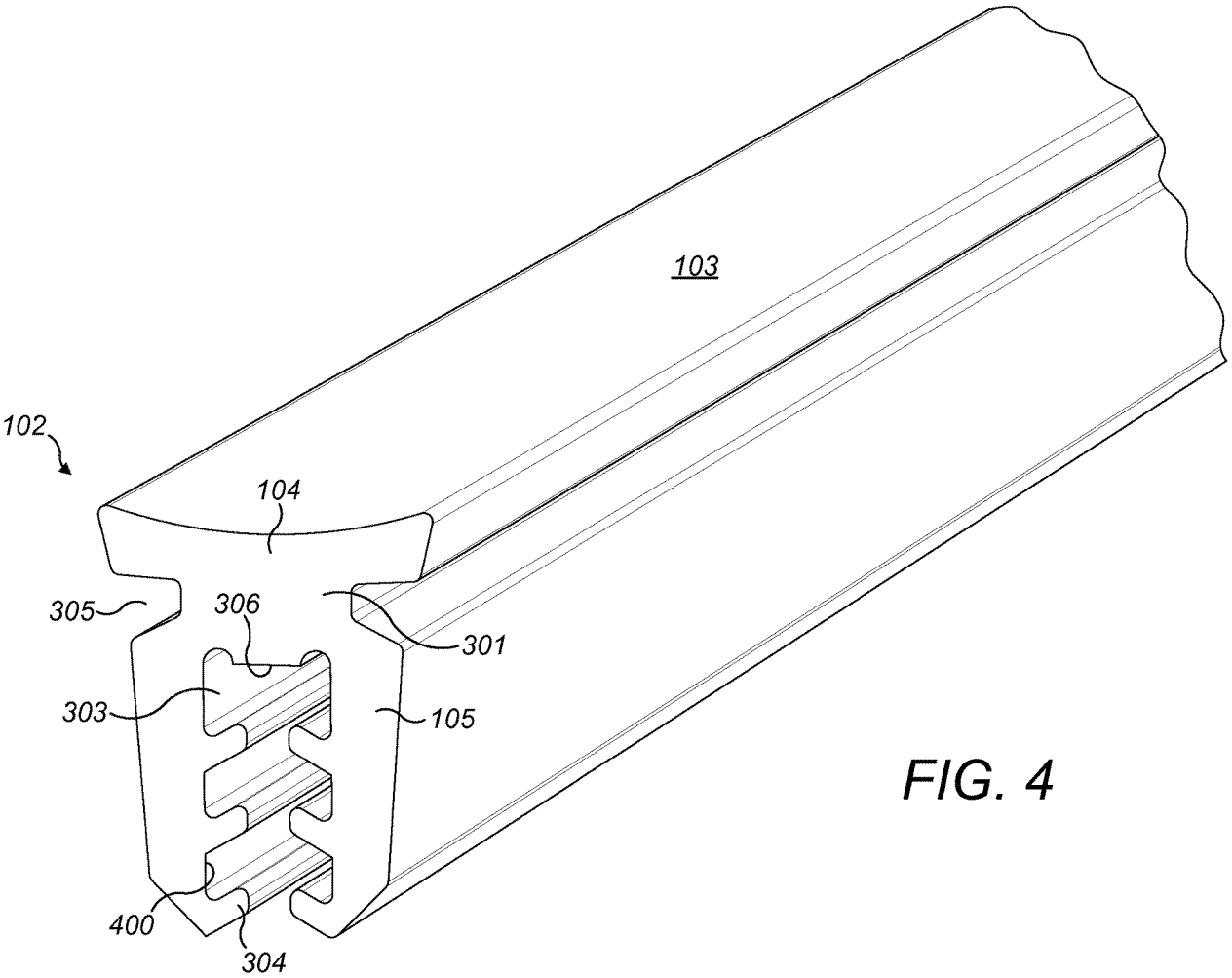
FIG. 4 is a perspective view of the capping of FIG. 3.

Referring to FIGS. 3 and 4, each capping 102 is generally elongate so as to comprise a main length in the z axis and a corresponding width in the lateral sideways direction of axis y. Accordingly, capping 102 is divided in the x axis (corresponding to a height of the capping 102) into the lower first region 105 configured to grip and mount at a respective support beam 101 and the generally upper second region 104 to support directly media 100 via its lowermost or downward facing surface 200. Lower region 105 is formed generally by a pair of elongate arms 105 whilst upper region 104 is formed generally by an elongate head 104 mounted at arms 105 via a neck 301. Arms 105 are spaced apart in the y axis so as to define a channel 303 being elongate in the z direction. In particular, channel 303 is defined between opposed inner faces 400 of each of the opposed arms 105 and a generally downward facing abutment surface 306 positioned directly below neck 301. A width of channel 303 in the y axis is slightly greater than a corresponding width of a support beam 101 so as to allow capping 102 to be mounted onto the uppermost end of beam 101 via abutment between capping abutment surface 306 and beam end surface 203. When mounted in position as illustrated in FIG. 3, the inner faces 400 of each arm 105 are positioned opposed and substantially coplanar with the side faces 300 of support beam 101 that extend in the x axis between the upper and lower end surfaces 202, 203. A plurality of flexible elongate fingers 304 project into channel 303 from each of the opposed inner faces 400 of each arm 105. Each of the fingers 304 are spaced apart at each face 300 in the height direction of capping 102 (x axis) and are inclined upwardly such that the innermost ends of each finger 304 are positioned closest to neck 301 relative to base regions of each finger 304 (formed at the junction with each respective arm 105). Accordingly, during mounting of capping 102 onto support beam 101, each of the fingers 304 is configured to flex and bend in the upward direction towards abutment surface 306 as the tips of each of the fingers brush against each of the beam side faces 300. The flexible fingers 304 are advantageous to provide a universal capping 102 suitable for mounting upon beams 101 of different width in the y axis. That is, wider support beams may be accommodated within channel 303 as fingers 304 are capable of flexing upwardly into the space between the adjacent arms 105 and the beam side faces 300. The inclined orientation of the fingers 304 is further advantageous to both increase the contact surface area with the beam side faces 300 and to be resistant to decoupling of the capping 102 from each beam 101 via a downward movement of beam 101 involving separation of the mating contact between abutment surface 306 and beam end face 203.

Figure 5:
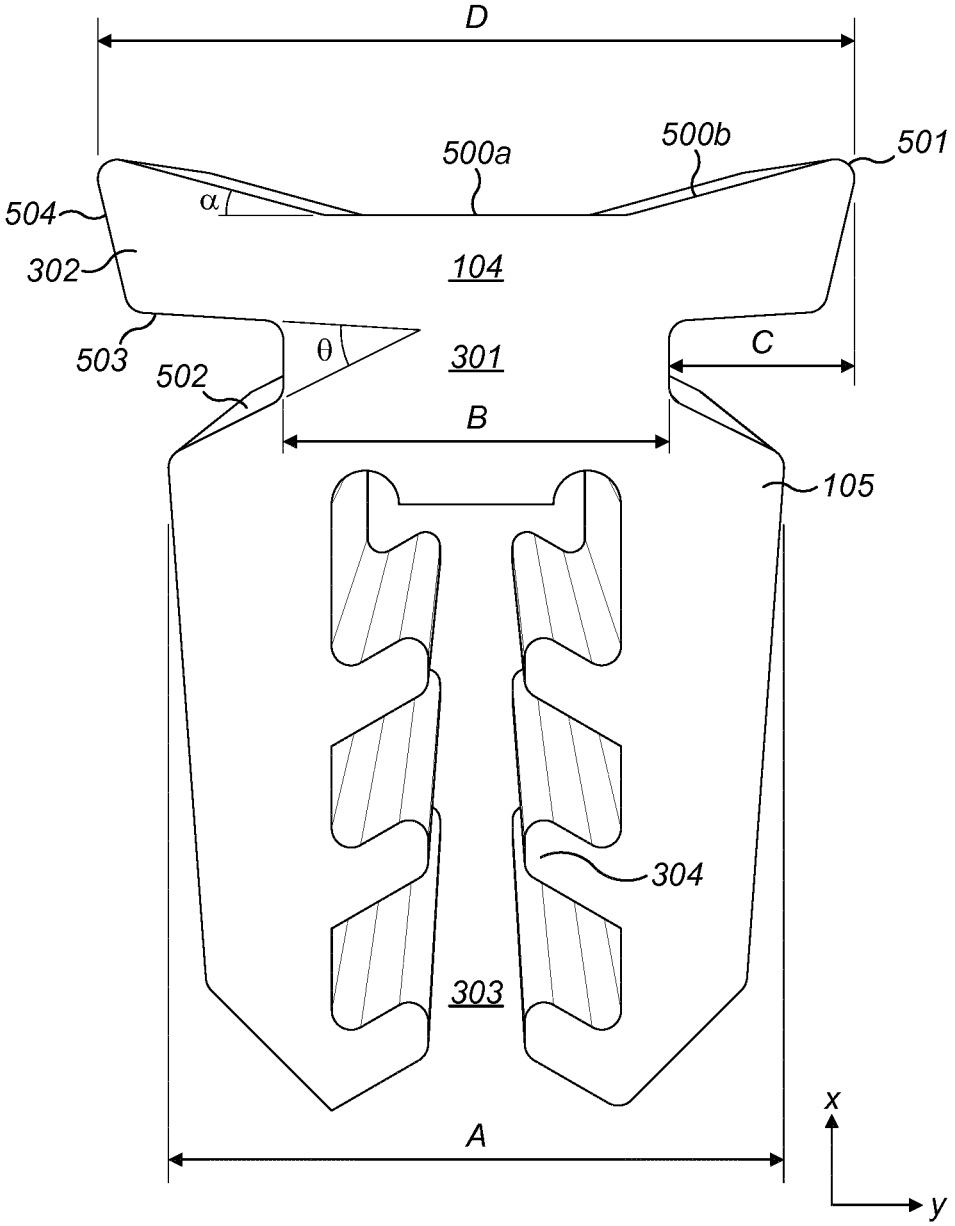
FIG. 5 is an end view of the capping of FIG. 4.

Referring to FIGS. 3 to 5, neck 301 provides a junction or bridge between the spaced apart arms 105 in the widthwise y direction and also provides separation in the height direction (x axis) of capping 102 between arms 105 and head 104. Referring to FIG. 5, a height of neck 301 in the x axis is approximately equal to or slightly less than a height of head 104 (immediately above neck 301). Advantageously, a width B of neck 301 in the y axis is less than a corresponding width of head 104 such that lateral end regions of head 104 overhand neck 301. Accordingly, a cross sectional profile of capping 102 perpendicular to its longitudinal length in the z axis comprises a generally T-shaped profile. Head 104 may therefore be considered to comprise lengthwise extending flanges 302 that extend laterally outward beyond neck 301 (in the y axis) being spatially separated in the height direction of capping 102 (in the x axis) by a distance corresponding to the height of neck 301 above arms 105. Accordingly, flanges 302 are separated from arms 105 by respective lengthwise extending channels 305 that allow flanges 302 to compress and bend downwardly in the x axis towards arms 105 when media contact surface 103 is positioned in contact with the underside surface 200 of media 100. According to the specific implementation, a height in the x axis of each channel 305 is approximately equal to a corresponding height of neck 301. However, according to the specific implementation, a width of each channel 305 increases in the laterally outward direction from neck 301 as an upper surface 502 at a shoulder region of each arm 105 is declined downwardly at an angle θ relative to an opposed downward facing surface 503 of each flange 302. According to the specific implementation, θ is in the range 25 to 35°. Such an arrangement is advantageous to provide sufficient clearance for the flex of flanges 302 when capping 102 is placed in contact to support the underside of media 100 in the crowned orientation between the screen deck sidewalls (not shown). Also, to ensure the head in both its lengthwise and widthwise directions (corresponding to the z and x axes) is maintained in close touching contact with the media underside surface 200, the upward facing media contact surface 103 at each flange 302 is inclined in the upward direction by an angle α. That is, head 104 at the media contact surface 103 may be divided in the widthwise direction into three sections including a central elongate section **500*a* positioned directly above neck 301 and two lateral side sections 500*b* positioned immediately above each flange 302. According to the specific implementation, surface 103 at sections 500*b* is orientated to be upwardly inclined at an angle 10 to 15° relative to the surface 103 at central section 500*a*. Accordingly, as the head 104 is brought into contact with media surface 200, flanges 302 are configured to deflect downwardly into respective channels 305 to ensure the entire surface area of media contact surface 103 is positioned in complete contact with the media underside surface 200. Such an arrangement is advantageous to close or 'blind' the open structure of the media 100 directly above each capping 102 and accordingly prevent stones or gravel becoming entrapped in the regions immediately above the cappings 102. As the uppermost surfaces 103 of flanges 302 at sections 500*b* are inclined upwardly, media contact surface 103 in the y axis may be considered to be concave or to comprise central innermost section 500*a* that is depressed in the height direction of axis x relative to the flange side sections 500*b***.

Stabilisation of the mounted position of the cappings 102 is achieved, in part, due to the extended surface area contact between head 104 and media surface 200 in the widthwise y axis. Stones and gravel are inhibited further from becoming entrapped at the region of capping head 104 as the flanges 302 comprise an undercut surface 504 that tapers inwardly towards neck 301 from a laterally outermost edge 501 of each flange 302. Flanges 302 overhang arms 105 in the lateral widthwise direction (y axis) such that head 104 is wider than arms 105. In particular, a maximum width A across both arms 105 at a region immediately above channel 303 is approximately 80% of a maximum width D of head 104.

In addition to the flexing of flanges 302 and fingers 304, arms 105 may also be configured to flex or bend laterally outward in the y axis so as to accommodate support beams 101 of different thickness. Such an arrangement provides a universal capping 102 suitable for mounting upon support beams 101 of different dimensions and geometries.

According to the specific implementation, capping 102 comprising arms 105, neck 301, and head 104 is formed as a unitary body from a resiliently compressible material. However, according to further specific implementations, head 104 (and optionally neck 301) may be formed from a first material being different to arms 105 (and optionally fingers 304) formed from a second material having different mechanical and physical properties relative to the first material.

The invention claimed is:

1. An elongate capping arranged to support tensioned screening media at a screen deck, the capping comprising:

a pair of opposed, spaced apart arms between which is defined a channel to receive and mount the capping on a longitudinal carrier beam of the screen deck;

a neck provided at one end of and forming a bridge between the arms; and a head provided at the neck and having flexible flanges that extend laterally outward from the neck, the flanges being configured to flex and resiliently compress towards the arms to support the screening media when mounted under tension on the head.

2. The capping as claimed in claim 1, wherein the head includes a media contact surface that extends over the flanges, the contact surface being concave in a lateral widthwise direction of the head between respective endmost edges of the flanges.

3. The capping as claimed in claim 1, wherein the includes a media contact surface that extends over the flanges, the contact surface being inclined over each flange in a lateral widthwise direction of the head relative to a central region positioned over the neck.

4. The capping as claimed in claim 1, wherein a distance by which each flange extends laterally outward from the neck is in a range 40 to 80% of a thickness of the neck in a lateral widthwise direction of the capping.

5. The capping as claimed in claim 4, wherein the range is 50 to 70%.

6. The capping as claimed in claim 1, wherein the flanges are separated from the arms in a height direction of the capping by a length of the neck in the height direction and a shoulder region of each arm at a junction with the neck is declined to slope downwardly away from each respective flange.

7. The capping as claimed in claim 1, wherein a thickness of each flange in a height direction of the capping increases in a lateral widthwise direction of the head such that widthwise outer regions of the flanges are thicker than corresponding widthwise inner regions of the flanges that form a junction with the neck.

8. The capping as claimed in claim 1, further comprising a plurality of fingers extending from each of the arms into the channel.

9. The capping as claimed in claim 8, wherein the fingers are inclined to extend in a direction within the channel towards the neck.

10. The capping as claimed in claim 8, comprising two arms and three fingers on each of the arms, the fingers being spaced apart in a height direction of the capping between a first end of each arm that is furthest from the neck and a second end of each arm connected to the neck.

11. The capping as claimed in claim 1, wherein the capping is made of a flexible material such that the flanges are resiliently compressible towards the arms.

12. The capping as claimed in claim 8, wherein the fingers are resiliently compressible towards each respective arm and/or the arms are resiliently expandable to open the channel to receive and mount the capping.

13. The capping as claimed in claim 11, wherein the flexible material comprises a rubber or a polyurethane.

14. A screen deck comprising:

a frame having a plurality of carrier beams;

a tensioned screening media supported upon the carrier beams; and a plurality of cappings mounted on the carrier beams to support in touching contact the screening media, each of the cappings including a pair of opposed, spaced apart arms between which is defined a channel to receive and mount the capping on the carrier beam, a neck provided at one end of and forming a bridge between the arms, and a head provided at the neck and having flexible flanges that extend laterally outward from the neck, the flanges being configured to flex and resiliently compress towards the arms to support the screening media when mounted under tension on the head.

15. The screen deck as claimed in claim 14, wherein the screening media includes an open structure or a plurality of apertures to allow the downward passage of media, the open structure or apertures extending continuously along a length of the media in a direction perpendicular to the carrier beams such that the cappings are positioned directly below the open structure or apertures and are configured to blind the open structure or apertures at a region of the media immediately above each respective capping.

* * * * *